US012195245B2

(12) United States Patent
Van Den Akker et al.

(10) Patent No.: US 12,195,245 B2
(45) Date of Patent: Jan. 14, 2025

(54) DISPLAYABLE SHIPPING CARTON

(71) Applicant: S.C. JOHNSON & SON, INC., Racine, WI (US)

(72) Inventors: Danielle Van Den Akker, Amsterdam (NL); Tim Zahnwetzer, Büchen (DE); Gemma Miragall Caselles, Rotterdam (NL)

(73) Assignee: S.C. JOHNSON & SON, INC., Racine, WI (US)

( * ) Notice: Subject to any disclaimer, the term of this patent is extended or adjusted under 35 U.S.C. 154(b) by 112 days.

(21) Appl. No.: 17/777,851

(22) PCT Filed: Oct. 26, 2020

(86) PCT No.: PCT/US2020/057296

§ 371 (c)(1),
(2) Date: May 18, 2022

(87) PCT Pub. No.: WO2021/101666

PCT Pub. Date: May 27, 2021

(65) Prior Publication Data

US 2022/0411125 A1 Dec. 29, 2022

Related U.S. Application Data

(60) Provisional application No. 62/939,229, filed on Nov. 22, 2019.

(30) Foreign Application Priority Data

Dec. 2, 2019 (EP) ..... 19000543

(51) Int. Cl.

| | |
|---|---|
| ***B65D 5/54*** | (2006.01) |
| ***B65D 5/02*** | (2006.01) |
| ***B65D 5/52*** | (2006.01) |

(52) U.S. Cl.
CPC ..... *B65D 5/5445* (2013.01); *B65D 5/0227* (2013.01); *B65D 5/5253* (2013.01); *B65D 5/542* (2013.01)

(58) Field of Classification Search
CPC ..... B65D 5/5253; B65D 5/5405; B65D 5/542
(Continued)

(56) References Cited

U.S. PATENT DOCUMENTS 2,822,118 A * 2/1958 Will ..... B65D 5/5425 229/243
3,002,613 A * 10/1961 Merkel ..... B65D 5/542 229/122

(Continued)

FOREIGN PATENT DOCUMENTS

DE 2320190 A1 11/1973
DE 4242780 A1 * 6/1994 ..... B65D 5/5425

(Continued)

OTHER PUBLICATIONS

DE 4242780 A1 Machine Translation (Year: 1994).*

(Continued)

*Primary Examiner* — Nathan J Newhouse
*Assistant Examiner* — Phillip D Schmidt
(74) *Attorney, Agent, or Firm* — Quarles & Brady LLP

(57) ABSTRACT

A carton blank includes a first main panel, a second main panel, a third main panel, and a fourth main panel. The blank further includes a pair of parallel lines of separation that extend through the first main panel, the second main panel, and the fourth main panel. The pair of parallel lines of separation are equidistant from one another throughout the first main panel, the second main panel, and the fourth main panel. Further, the pair of parallel lines of separation define a first tear feature that extends through the first main panel and the second main panel, and a second tear feature that (Continued)

extends through the fourth main panel. The blank also includes a single line of separation that extends through the third main panel, connecting the first and second tear features.

20 Claims, 9 Drawing Sheets

(58) Field of Classification Search
USPC ..... 229/120.09, 240, 242, 235; 206/746, 206/736, 747, 749–750
See application file for complete search history.

(56) References Cited

U.S. PATENT DOCUMENTS 3,056,665 A * 10/1962 Linda ..... B65D 5/5445 206/206
3,160,274 A * 12/1964 Pritchard ..... B65D 5/5445 206/774
3,263,900 A 8/1966 Martin
3,291,372 A * 12/1966 Saidel ..... B65D 5/5445 229/101
3,385,430 A 5/1968 Benzon-Petersen
3,653,495 A 4/1972 Gray
4,000,811 A 1/1977 Hardison
4,111,297 A * 9/1978 Paulin ..... B65D 83/0088 229/235
4,113,100 A 9/1978 Soja et al.
4,815,609 A 3/1989 Keidaisch
4,865,187 A * 9/1989 Zulauf ..... B65D 5/54 229/122
4,932,534 A 6/1990 Focke et al.
5,058,748 A 10/1991 Giblin et al.
5,722,584 A 3/1998 Fujiwara
5,921,398 A 7/1999 Carroll
6,129,211 A 10/2000 Prakken et al.
6,386,369 B2 5/2002 Yuhas et al.
6,402,016 B1 * 6/2002 Lee ..... B65D 5/5206 229/242
6,523,692 B2 2/2003 Gregory
6,729,475 B2 5/2004 Yuhas et al.
7,066,379 B2 6/2006 McLeod et al.
7,225,930 B2 6/2007 Ford et al.
7,284,662 B2 10/2007 DeBusk et al.
7,588,143 B2 9/2009 Focke et al.
7,658,318 B2 2/2010 Walsh et al.
7,717,322 B2 5/2010 Walsh et al.
7,784,675 B2 * 8/2010 Sutherland ..... B65D 5/5253 206/427
8,025,618 B2 9/2011 Walsh et al.
8,033,449 B2 10/2011 Ho Fung et al.
8,376,141 B2 2/2013 Couture
8,590,773 B2 11/2013 Moreau et al.
8,622,280 B2 * 1/2014 Coltri-Johnson .... B65D 5/4608 229/242
8,789,704 B2 7/2014 Nowak
8,794,445 B2 * 8/2014 Wurth ..... B65D 5/427 229/162.1
8,827,144 B2 11/2014 Gomes et al.
9,260,215 B2 2/2016 Coltri-Johnson et al.
9,738,413 B2 8/2017 Humphrey et al.
10,273,043 B2 4/2019 Couture
2002/0170845 A1 11/2002 Oliff
2006/0006096 A1 1/2006 Funk
2006/0255107 A1 11/2006 Wright
2006/0266815 A1 * 11/2006 Coltri-Johnson .... B65D 5/5253 229/242
2007/0131749 A1 * 6/2007 Coltri-Johnson ..... B65D 5/566 229/242
2007/0295793 A1 * 12/2007 Ho Fung ..... B65D 71/36 229/242
2007/0295796 A1 12/2007 Sutherland et al.
2011/0259947 A1 10/2011 Brittain
2014/0216981 A1 8/2014 Kuhn
2018/0170609 A1 6/2018 Collier et al.
2019/0084716 A1 3/2019 Collier et al.

FOREIGN PATENT DOCUMENTS

DE 29712908 U1 * 9/1997 ..... B65D 5/542
EP 1072523 A1 1/2001
EP 3202680 B1 12/2018
GB 1520806 A * 8/1978 ..... B65D 5/5445
WO 03024834 A1 3/2003
WO WO-2007047353 A2 * 4/2007 ..... B65D 5/445
WO WO-2011091339 A2 * 7/2011 ..... B65D 5/541
WO 2014118279 A1 8/2014
WO 2018095981 A1 5/2018
WO 2018149918 A1 8/2018

OTHER PUBLICATIONS

International Search Report and Written Opinion for PCT/US2020/057296, mailed Jan. 29, 2021 (8 pages).
Extended European Search Report for Application No. 19000543.9, mailed Sep. 15, 2020 (13 pages).
"Smurfit Kappa—Giving the coffee industry a break" https://www.youtube.com/watchv=5JHFFgt_tOI, published Jun. 19, 2014, accessed Apr. 26, 2022 (1 page).
European Examination Report in Application No. EP 19000543.9, dated May 4, 2023 (6 pages).

* cited by examiner 160
154
108
132
128
C
102
300
134
P
P
P

DISPLAYABLE SHIPPING CARTON

CROSS REFERENCE TO RELATED APPLICATIONS

This application is a U.S. National Stage application, filed pursuant to 35 U.S.C. § 371, of international application no. PCT/US2020/057296, filed on Oct. 26, 2020, which claims priority to U.S. Provisional Application Ser. No. 62/939,229, filed on Nov. 22, 2019, and European Patent Application No. 19000543, filed on Dec. 2, 2019, each of which is incorporated herein by reference in its entirety.

REFERENCE REGARDING FEDERALLY SPONSORED RESEARCH OR DEVELOPMENT

Not applicable.

SEQUENCE LISTING

Not applicable.

BACKGROUND OF THE DISCLOSURE

1. Field of the Disclosure

The present disclosure relates generally to cartons for shipping and displaying products sold at retail, such as pouches, blister packaging, or other types of packaging, and more particularly, to a carton that provides for efficient shipping and that has tear features that may be easily removed at a display location so that at least part of the product can be viewed by prospective buyers without the store owner having to remove the product from the carton.

2. Description of the Background of the Disclosure

After being manufactured, retail products are commonly packaged in a generally rectangular carton for containing, transporting, and preferably, displaying the product at a retail location. Frequently, retailers want to display such products so that at least a part of the appearance of the product can be viewed by prospective buyers. However, retailers do not want the added expense of removing the products from the carton and placing the products on a display shelf. Therefore, shelf-ready packaging (SRP) carton configurations have been proposed that allow a retailer to remove a portion of a carton and place the remaining carton on a display shelf so that a consumer may view the product and readily remove the product from the carton. Typically, SRP's utilize perforated or tear portions to assist in removing portions of the carton.

Prior known shelf-ready packaging cartons comprise one row or set of products positioned at the bottom of the carton. In such a configuration, the top portion of the carton is empty, which creates wasted space. Further, such prior known packaging typically takes a considerable amount of time to properly stock on shelves in a retail environment. Additionally, many prior art cartons are not able to efficiently hold multiple products with irregular shapes.

Other solutions include double shelf-ready packaging cartons that comprises two rows or sets of products that are nested with each other. In such a configuration, the double shelf-ready packaging carton allows for the amount of products to be doubled while reducing the amount of wasted space in the carton, therefore reducing packaging waste and transportation space, i.e., lowering costs to produce and distribute. However, such prior art cartons often suffer from various inefficiencies. For example, a user or retailer may not be able to effectively see the product within the carton. Furthermore, many such prior art cartons are not intuitive to open, which results in the user or retailer mistakenly tearing perforated portions of the SRP in the wrong direction. Opening such a carton incorrectly may cause product within the carton to fall out or the carton to become inoperable, especially when the products in the carton have an asymmetric or irregular shape.

A solution is therefore needed to provide a double shelf-ready packaging carton that is intuitive to open and that allows multiple products to be stored within that maximizes space and reduces manufacturing and transportation costs.

SUMMARY OF THE INVENTION

According to a first aspect, a carton blank includes a first main panel, a second main panel foldably attached with the first main panel, a third main panel foldably attached with the second main panel, and a fourth main panel foldably attached with the third main panel. The carton blank further includes a pair of parallel lines of separation that extend through the first main panel, the second main panel, and the fourth main panel. The pair of parallel lines of separation are equidistant from one another throughout the first main panel, the second main panel, and the fourth main panel. Further, the pair of parallel lines of separation define a first tear feature that extends through the first main panel and the second main panel, and a second tear feature that extends through the fourth main panel. Furthermore, the carton blank includes a single line of separation extending through the third main panel, connecting the first and second tear features.

According to some embodiments, the carton blank comprises at least one cutout extending through at least one of the first main panel, the second main panel, or the fourth main panel along at least one of the pair of parallel lines of separation. A portion of the at least one cutout may extend partially into at least one of the first tear feature or the second tear feature. In another embodiment, the first tear feature includes a finger hole extending through the second main panel. In a different embodiment, a plurality of end flaps are foldably attached to and extend from opposite ends of each of the first main panel, the second main panel, the third main panel, and the fourth main panel by way of a plurality of peripheral edges. The pair of parallel lines of separation may be parallel and equidistant with the peripheral edges defined by the plurality of end flaps.

According to another aspect, a carton blank includes a first main panel, a second main panel foldably attached with the first main panel, a third main panel foldably attached with the second main panel, and a fourth main panel foldably attached with the third main panel. The carton blank further includes a pair of uninterrupted end flaps foldably attached to and that extend from opposite ends of each of the first main panel, the second main panel, the third main panel, and the fourth main panel by way of a plurality of peripheral edges. Further, the carton blank comprises a pair of parallel lines of separation that extend through the first main panel, the second main panel, and the fourth main panel. The pair of parallel lines of separation are equidistant from one another and from the peripheral edges of each main panel throughout the first main panel, the second main panel, and the fourth main panel. Furthermore, the pair of parallel lines of separation define a first tear feature that extends through the first main panel and the second main panel, and a second tear feature that extends through the fourth main panel. Additionally, the carton blank includes a single line of separation that extends through a middle of the third main panel, connecting the first and second tear features. The carton blank also includes a plurality of uninterrupted attachment flaps that extend from the first main panel, opposite the second main panel.

In some embodiments, the carton blank comprises at least one cutout that extends through at least one of the first main panel, the second main panel, or the fourth main panel along the pair of parallel lines of separation. A portion of the at least one cutout may extend partially into at least one of the first tear feature or the second tear feature. In a different embodiment, the first tear feature includes a finger hole that extends through the second main panel. In another embodiment, the first tear feature extends from one of the plurality of uninterrupted attachment flaps.

According to yet another aspect, a carton includes a first main panel, a second main panel foldably attached with the first main panel, a third main panel foldably attached with the second main panel, and a fourth main panel foldably attached with the third main panel. The carton further includes a pair of uninterrupted end flaps foldably attached to and that extend from opposite ends of at least one of the first main panel, the second main panel, the third main panel, or the fourth main panel by way of a peripheral edge of each main panel. Further, the carton includes a first perforated tear pattern extending through the first main panel and the second main panel, and a second perforated tear pattern that extends through the fourth main panel. Furthermore, the carton includes a third perforated tear pattern that extends through a middle of the third main panel, and which connects the first and second perforated tear patterns. The first perforated tear pattern and the second perforated tear pattern are parallel with the peripheral edges. Additionally, the first perforated tear pattern and the second perforated tear pattern are equidistant from the peripheral edges of each main panel throughout the first main panel, the second main panel, and the fourth main panel. The first perforated tear pattern and the second perforated tear pattern are aligned and co-extensive with one another.

In some embodiments, the carton comprises an attachment flap that is configured to attach with an interior surface of the fourth main panel. Further, the attachment flap may extend from the first main panel. In other embodiments, the first perforated tear pattern and the second perforated tear pattern are attached to one another. Furthermore, the first perforated tear pattern may comprise an attachment flap extending therefrom, where the attachment flap is configured to attach to an interior surface of the second perforated tear pattern. In a different embodiment, removal of the first perforated tear pattern results in the removal of the second perforated tear pattern from the carton. Additionally, upon removal of the first perforated tear pattern and the second perforated tear pattern, the carton may transform into two dispenser sections, side-by-side to each other, wherein the dispenser sections are removable from each other. In other embodiments, the carton is capable of rotating along the third perforated tear pattern. The carton may be further capable of separating into two detached dispenser sections along the first perforated tear pattern, the second perforated tear pattern, and the third perforated tear pattern.

DETAILED DESCRIPTION OF THE DRAWINGS

The present disclosure is directed to a displayable shipping carton and methods of transforming the displayable shipping carton into two display sections. While the present disclosure may be embodied in many different forms, several specific embodiments are discussed herein with the understanding that the present disclosure is to be considered only an exemplification of the principles of the disclosure, and it is not intended to limit the disclosure to the embodiments illustrated. Throughout the disclosure, the terms "about" and "approximately" refer to a range of values ±5% of the numeric value that each term precedes.

Figure 1:
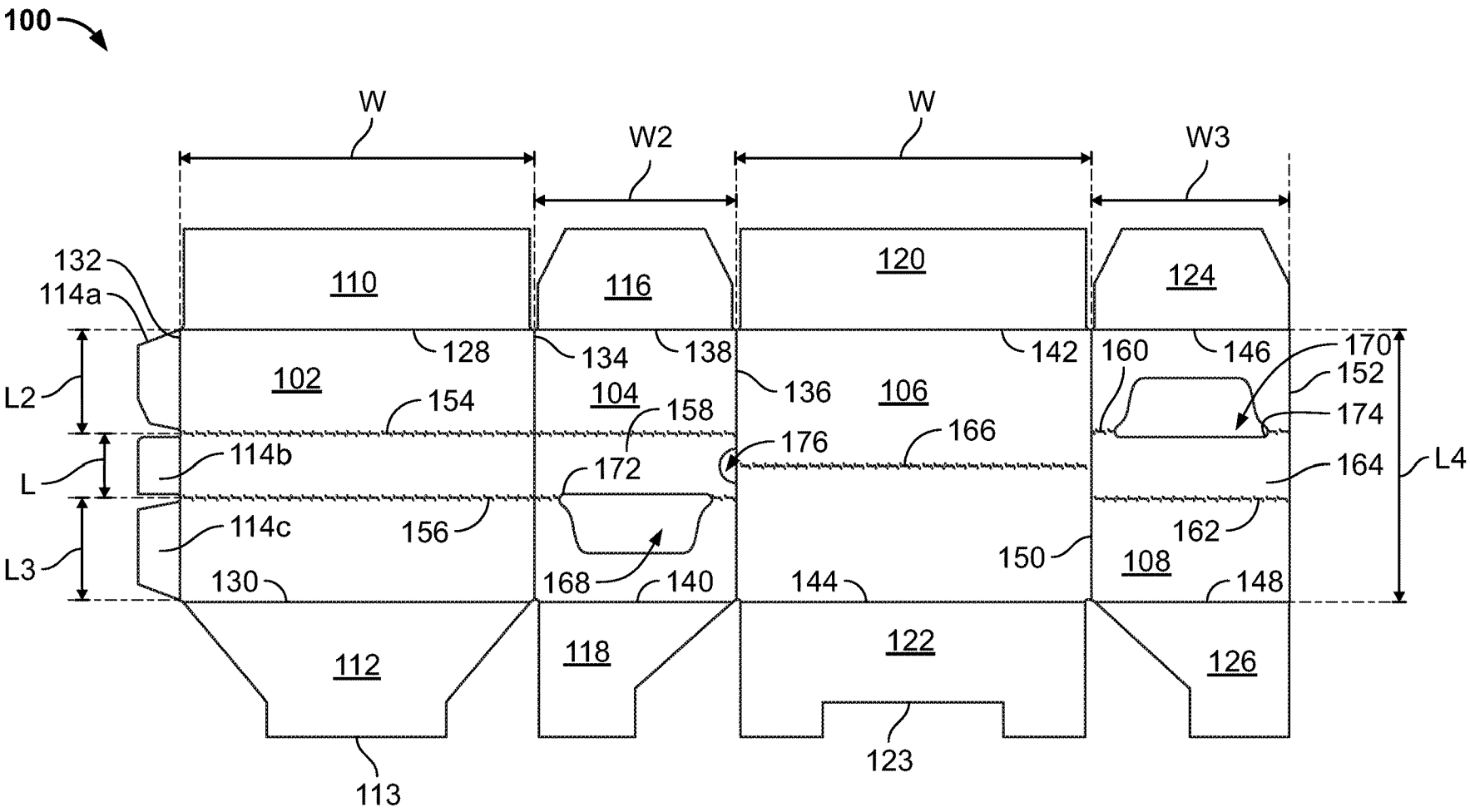
FIG. 1 is a plan view of a blank in accordance with the present disclosure.

Referring now to FIG. 1, a single planar blank 100 that may be assembled into a displayable shipping carton is depicted. The blank 100 may be formed of cardboard, corrugated paperboard, stiffened plastic sheeting, or any other conventional carton or blank material. The blank 100 includes a first main panel 102, a second main panel 104 foldably attached with the first main panel 102, a third main panel 106 foldably attached with the second main panel 104, and a fourth main panel 108 foldably attached with the third main panel 106.

The first main panel 102 includes a first upper end flap 110 and a first lower end flap 112 foldably attached to and extending from opposite ends of the first main panel 102. The first lower end flap 112 may comprise a rectangular portion 113 extending at the distal end of the first lower end flap 112. Additionally, the first main panel 102 includes a plurality of uninterrupted attachment flaps 114*a*, 114*b*, 114*c* that extend from the first main panel 102, opposite the second main panel 104. As illustrated in FIG. 1, the blank 100 comprises three attachment flaps 114*a*, 114*b*, 114*c*, however, in alternative embodiments, the blank 100 may comprise a greater or fewer number of attachment flaps 114*a*, 114*b*, 114*c*. For example, the attachment flaps 114*a*, 114*b*, 114*c* may comprise a single flap extending from the first main panel 102. Additionally, the attachment flaps 114*a*, 114*b*, 114*c* may extend from the fourth main panel 108 instead of the first main panel 102. In further embodiments, the attachment flaps 114*a*, 114*b*, 114*c* may comprise fold lines or perforations extending adjacent the first main panel 102 or otherwise therethrough (see FIG. 9).

Referring still to FIG. 1, the second main panel 104 includes a second upper end flap 116 and a second lower end flap 118 foldably attached to and extending from opposite ends of the second main panel 104. The third main panel 106 also includes a third upper end flap 120 and a third lower end flap 122 foldably attached to and extending from opposite ends of the third main panel 106. The third lower end flap 122 comprises an edge 123 that is positioned inward with respect to the distal edge of the third lower end flap 122 and within a rectangular cutout portion. Finally, the fourth main panel 108 includes a fourth upper end flap 124 and a fourth lower end flap 126 foldably attached to and extending from opposite ends of the fourth main panel 108.

As depicted in the present embodiments, each of the upper end flaps 110, 116, 120, 124 and the lower end flaps 112, 118, 122, 126 are uninterrupted, such that the upper end flaps 110, 116, 120, 124 and the lower end flaps 112, 118, 122, 126 do not comprise any perforations or fold lines extending therethrough. However, in alternative embodiments, the blank 100 may comprise perforations or fold lines extending through the upper end flaps 110, 116, 120, 124 and the lower end flaps 112, 118, 122, 126.

Referring still to FIG. 1, the first main panel 102 includes an upper peripheral edge 128 and a lower peripheral edge 130 that are fold or score lines for the first upper end flap 110 and the first lower end flap 112, respectively. Additionally, the first main panel 102 includes a first vertical fold or score line 132 that separates the first main panel 102 from the attachment flaps 114*a*, 114*b*, 114*c*. Further, a second vertical fold or score line 134 separates the first main panel 102 from the second main panel 104, and a third vertical fold or score line 136 separates the second main panel 104 from the third main panel 106. The second main panel 104 also includes an upper peripheral edge 138 and a lower peripheral edge 140 that are fold or score lines for the second upper end flap 116 and the second lower end flap 118, respectively. Continuing on to the third main panel 106, the third main panel 106 also includes an upper peripheral edge 142 and a lower peripheral edge 144 that are fold or score lines for the third upper end flap 120 and the third lower end flap 122, respectively. Moreover, the fourth main panel 108 includes an upper peripheral edge 146 and a lower peripheral edge 148 that are fold or score lines for the fourth upper end flap 124 and the fourth lower end flap 126, respectively. Furthermore, a fourth vertical fold or score line 150 separates the third main panel 106 from the fourth main panel 108. In this embodiment, a cut edge 152 of the blank 100 defines one side of the fourth main panel 108, opposite the third main panel 106. As such, the attachment flaps 114*a*, 114*b*, 114*c* and the cut edge 152 define two distal edges of the blank 100. In alternative embodiments, the cut edge 152 may include grooves or portions that extend into the fourth main panel 108.

Referring still to FIG. 1, the first main panel 102 and the third main panel 106 comprise a width W. In alternative embodiments, the width W may define a greater or smaller distance than shown to accommodate a different amount of articles or products P (see FIG. 8). As such, the greater the width W, the greater the amount of the products P that can be placed in the blank 100. Additionally, the smaller the width W, the fewer the amount of the products P that can be placed in the blank 100. Therefore, there is a direct correlation with the width W and the amount of the products P that the blank 100 may hold. In one example, the first main panel 102 and the third main panel 106 may define a smaller width W than shown, while the second main panel 104 and the fourth main panel 108 remain the same. Additionally, in other embodiments, the length and width dimensions of all the main panels 102, 104, 106, 108 may be greater or smaller than shown in FIG. 1. As such, the surface area defined by the main panels 102, 104, 106, 108 in FIG. 1 is not limiting. Furthermore, the upper end flaps 110, 116, 120, 124 and the lower end flaps 112, 118, 122, 126 are proportional to the blank's 100 dimensions. As a result, the upper end flaps 110, 116, 120, 124 and the lower end flaps 112, 118, 122, 126 size may vary depending on the dimensions of the main panels 102, 104, 106, 108. In alternative embodiments, the upper end flaps 110, 116, 120, 124 and the lower end flaps 112, 118, 122, 126 may comprise any geometric shape as long as the upper end flaps 110, 116, 120, 124 can sufficiently close the upper end of the blank 100 and the lower end flaps 112, 118, 122, 126 can sufficiently close the lower end of the blank 100.

Referring again to FIG. 1, the blank 100 includes a first line of separation 154 and a second line of separation 156 that extend from the first vertical fold or score line 132 to the third vertical fold or score line 136 through the entire first main panel 102 and the second main panel 104. The first line of separation 154 and the second line of separation 156 define a first tear feature 158 that extends from the attachment flap 114*b* through the first main panel 102 and the second main panel 104. As such, the attachment flap 114*b* is in contact with the first tear feature 158. Furthermore, the first line of separation 154 and the second line of separation 156 are parallel lines of separation that are equidistant from one another, defining a length L. Further, the first line of separation 154 and the upper peripheral edges 128, 138 define a length L2, and the second line of separation 156 and the lower peripheral edges 130, 140 define a length L3. In preferred embodiments, the length L2 and the length of L3 are equal, such that the first line of separation 154 and the second line of separation 156 are equidistant from and parallel to the upper peripheral edges 128, 138 and the lower peripheral edges 130, 140 of the first main panel 102 and the second main panel 104, respectively.

In other embodiments, the distance defined by the length L2 and the length L3 may be greater or smaller than illustrated, therefore the length L may also be greater or smaller than illustrated. Further, in alternative embodiments, the length L2 and L3 may not be equal such that one may be larger than the other. In further embodiments, the first line of separation 154 and the second line of separation 156 may not be parallel to each other and may converge or diverge from each other while they extend through the first main panel 102 and the second main panel 104. As such, the first line of separation 154 and the second line of separation 156 may define any perforated tear pattern extending through the first main panel 102 and the second main panel 104.

Referring still to FIG. 1, the blank 100 further includes a third line of separation 160 and a fourth line of separation 162 which define a second tear feature 164 that extends through the fourth main panel 108, from the fourth vertical fold or score line 150 to the cut edge 152. The third line of separation 160 and the fourth line of separation 162 are parallel lines of separation, and the third line of separation 160 and the fourth line of separation 162 are equidistant from one another and from the upper peripheral edge 146 and the lower peripheral edge 148 throughout the fourth main panel 108. Further, the third line of separation 160 and the fourth line of separation 162 are parallel with the upper peripheral edges 146 and the lower peripheral edges 148. As noted herein, the third line of separation 160 and the first line of separation 154 are aligned with each other such that the third line of separation 160 and the upper peripheral edge 146 also define the length L2. Further, the second line of separation 156 and the fourth line of separation 162 are also aligned with each other such that the fourth line of separation 162 and the lower peripheral edge 148 additionally define the length L3. Therefore, the third line of separation 160 and the fourth line of separation 162 also share the length L therebetween. In alternative embodiments, the length L may be greater or smaller than shown. In other embodiments, the third line of separation 160 and the fourth line of separation 162 may not be parallel and may converge or diverge from each other while they extend through the fourth main panel 108. As such, the third line of separation 160 and the fourth line of separation 162 may define any perforated tear pattern extending through the fourth main panel 108.

Referring again to FIG. 1, the third main panel 106 comprises a fifth or single line of separation 166 that extends from the third vertical fold or score line 136 to the fourth vertical fold or score line 150. The single line of separation 166 extends through the middle of the third main panel 106, connecting the first tear feature 158 and the second tear feature 164. Further, in alternative embodiments, the single line of separation 166 may define any perforated tear pattern extending through the middle of the third main panel 106. In other embodiments, the third main panel 106 may comprises two or more lines of separation extending therethrough. For example, two parallel lines of separation may extend through the third main panel 106 instead of the single line of separation 166.

As noted herein, the lines of separation 154, 156, 160, 162, 166 may define any type of pattern or disruption extending through or into the blank 100. For example, the lines of separation 154, 156, 160, 162, 166 may include one or more of perforated lines, perforated tear patterns, fold lines, tear lines, crease lines, or the like. Further, the lines of separation 154, 156, 160, 162, 166 may include hybrid lines that function like a fold line and a tear line, for example. As such, the lines of separation 154, 156, 160, 162, 166 may define any type of disruption extending partially or entirely through the blank 100, insofar as they operate to assist in the separation of adjacent portions of the blank from one another.

Referring still to FIG. 1, the blank 100 includes a first cutout 168 that extends through the second main panel 104 along the second line of separation 156. Additionally, the blank 100 also includes a second cutout 170 that extends through the fourth main panel 108 along the third line of separation 160. The first and second cutouts 168, 170 extend in opposite directions from one another. An edge 172 of the second main panel 104, defined by the first cutout 168, is coextensive with the second line of separation 156. Further, an edge 174 of the fourth main panel 108, defined by the second cutout 170, is coextensive with the third line of separation 160. Further, the first cutout 168 extends partially into the first tear feature 158, and the second cutout 170 extends partially into the second tear feature 164. The first and second cutouts 168, 170 define a generally frustoconical shape, however, in alternative embodiments, the first and second cutouts 168, 170 may define any shape or configuration such that at least one edge of each of the shapes is coextensive with at least a portion of one of the lines of separation 154, 156, 160, 162. Thus, in alternative embodiments, the first main panel 102, the second main panel 104, or the fourth main panel 108 may comprise the cutouts 168, 170 extending therethrough. In further embodiments, the blank 100 may comprise a greater or fewer number of cutouts 168, 170 and the cutouts 168, 170 may be positioned on different lines of separation 154, 156, 160, 162. As will become more apparent upon further discussion herein, the cutouts 168, 170 allow for the products P to be better viewed by a consumer or user.

Referring again to FIG. 1, the first tear feature 158 includes a finger hole 176 extending through the second main panel 104. The finger hole 176 defines a semi-circular shape and is entirely defined in the first tear feature 158. Further, the finger hole 176 is adjacent to the single line of separation 166 that extends along the third main panel 106. The finger hole 176 helps a user initiate the removal of the first tear feature 158. In alternative embodiments, the first tear feature 158 may include a tab protruding from the first tear feature 158 instead of a finger hole 176. Additionally, the finger hole 176 may be any shape such as, a square, a triangle, or a rectangle, for example.

Referring still to FIG. 1, the second main panel 104 comprises a width W2 and the fourth main panel 108 comprises a width W3. Further, the main panels 102, 104, 106, 108 comprise a length L4, which is defined by the combination of the length L, the length L2, and the length L3. As discussed above, the length and width dimensions of all the main panels 102, 104, 106, 108 may be greater or smaller than illustrated. In preferred embodiments, the ratio between the width W and the length L4, i.e., W/L4, is between about 0.5 and about 0.9, or between about 1.0 and about 1.6, or about 1.3. Additionally, the ratio between the length L and the length L4, i.e., L/L4, is between about 0.05 and about 0.5, or between about 0.2 and about 0.3, or about 0.3. Further, the ratio between the width W2 and the width W, i.e., W2/W, is between about 0.4 and about 0.7, or between about 0.8 and about 1.1, or about 0.6. It will be apparent to those skilled in the art that the proportions listed above are non-limiting and only examples of one embodiment of the blank 100.

Figure 2:
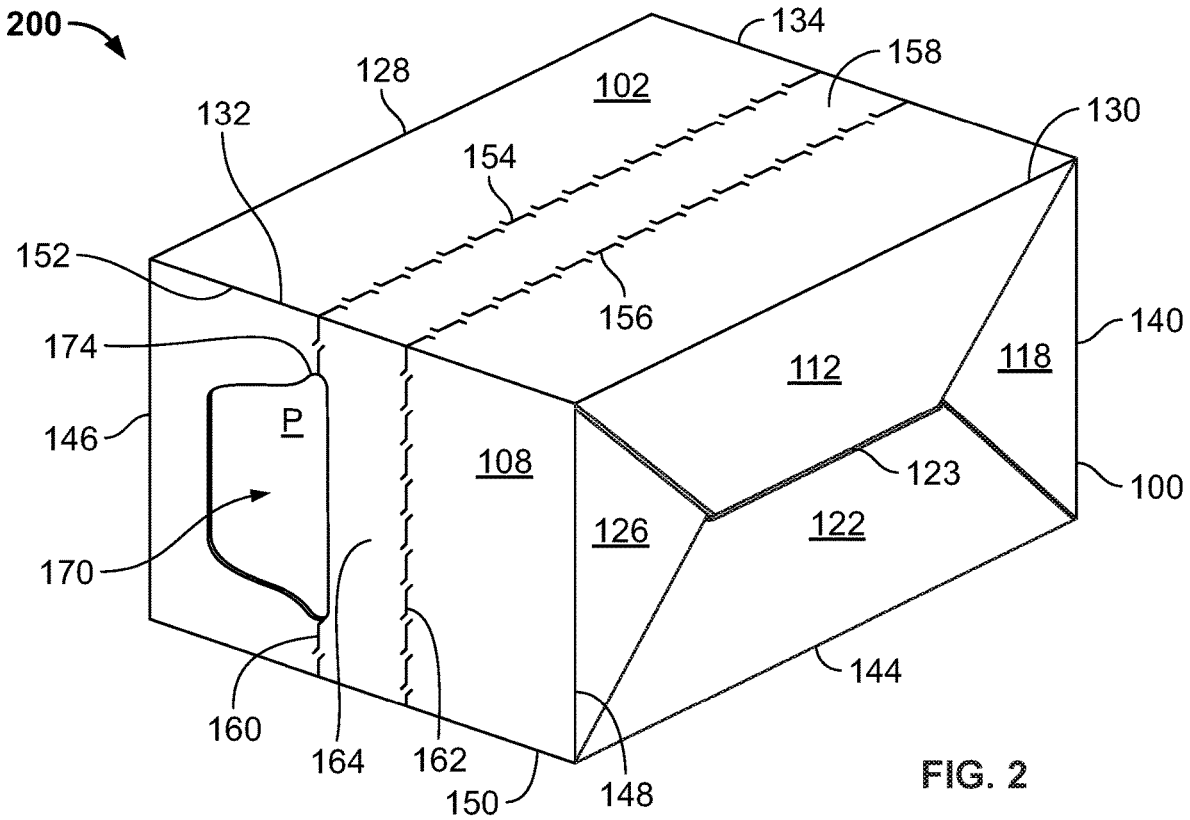
FIG. 2 is an isometric view of a displayable shipping carton formed from the blank of FIG. 1.
Figure 3:
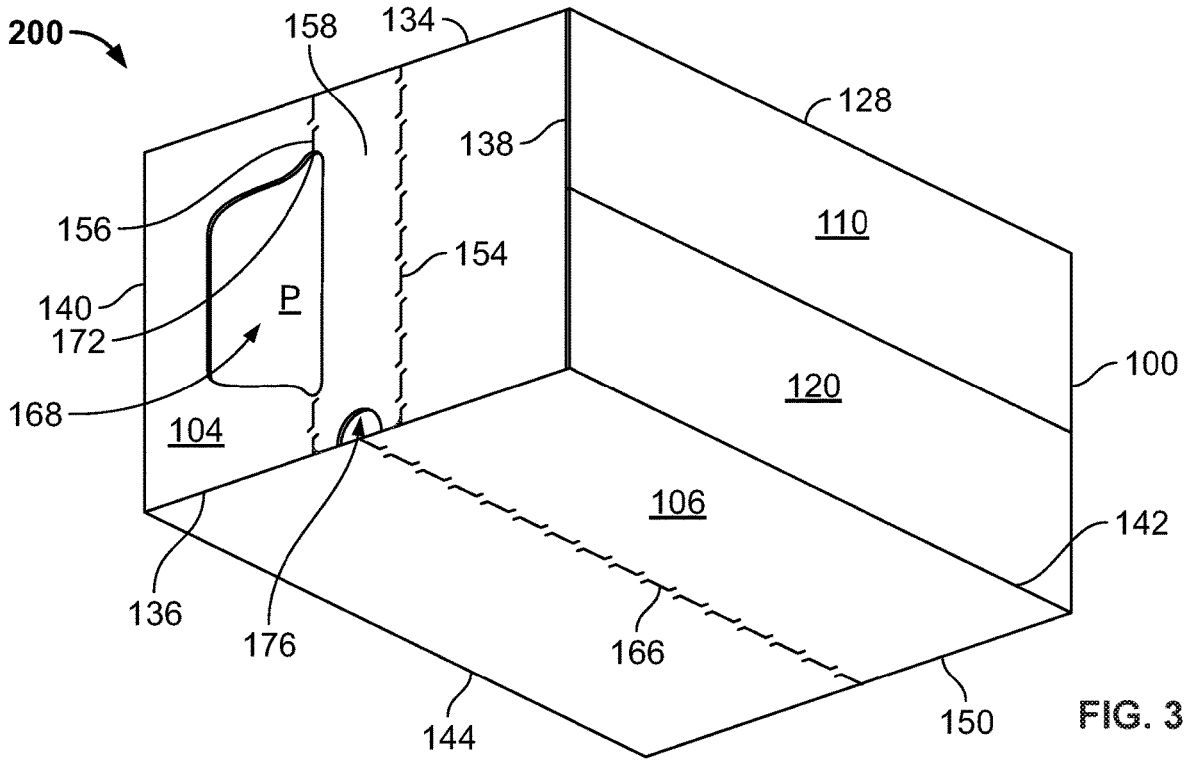
FIG. 3 is an alternative isometric view of the displayable shipping carton of FIG. 2 viewed from the opposite side.

Referring now to FIGS. 2 and 3, opposing isometric views of a displayable shipping carton 200 formed from the blank 100 are depicted. With reference to FIGS. 1-3, an adhesive is applied to the attachment flaps 114*a*, 114*b*, 114*c* and the blank 100 is folded along the first, second, third, and fourth vertical fold or score lines 132, 134, 136, 150 so that the adhesive surface of the attachment flaps 114*a*, 114*b*, 114*c* is configured to attach to an interior surface (not shown) of the fourth main panel 108 to form a rectangular structure. In one example, the adhesive may be a glue, however, any type of adhesive may be used. In fact, it is anticipated that other types of attachments mechanisms such as tape, staples, or other means known to those of ordinary skill, may be used such that the attachment flaps 114*a*, 114*b*, 114*c* are securely coupled to the fourth main panel 108. In preferred embodiments, the attachment flap 114*b* is configured to attach to the interior surface of the second tear feature 164, and the attachment flaps 114*a*, 114*c* are configured to attach to portions of the interior surface of the fourth main panel 108, i.e., the attachment flaps 114*a*, 114*c* do not contact the second tear feature 164. As a result of this configuration, once the blank 100 is assembled, the first tear feature 158 and the second tear feature 164 are adjacent and in contact with each other, such that when the user tears the first tear feature 158, the second tear feature 164 will also be torn away.

Once the above noted step is complete, and with reference to FIGS. 1 and 2, the third lower end flap 122 is folded 90 degrees toward the interior of the carton 200 along the peripheral edge 144 of the third main panel 106. Once the third lower end flap 122 is folded downwardly, the second lower end flap 118 and the fourth lower end flap 126 are folded 90 degrees, over the third lower end flap 122, toward the interior of the carton 200 along the peripheral edges 140, 148 of the second and fourth main panels 104, 108, respectively. Once the second and fourth lower end flaps 118, 126 are folded downwardly, the first lower end flap 112 is folded 90 degrees along the lower peripheral edge 130 of the first main panel 102. Once folded, the rectangular portion 113 of the first lower end flap 112 is placed and secured under the edge 123 of the third lower end flap 122 (see FIG. 2), thereby securing the first lower end flap 112 to the third lower end flap 122.

It is contemplated that the first and third lower end flaps 112, 122 may be further fastened together by way of an adhesive or other attachment means. In one example, tape may be placed along portions of the first and third lower end flaps 112, 122, such that the first and third lower end flaps 112, 122 may be securely fastened to each other. In alternative embodiments, an adhesive may be placed on the second and fourth lower end flaps 118, 126 prior to folding the end flaps 112, 118, 122, 126 together. With this approach, the adhesive may then securely fasten the first and third lower end flaps 112, 122 to the second and fourth lower end flaps 118, 126. In other embodiments, this step may be omitted. As such, the first lower end flap 112 and the third lower end flap 122 may be fully secured to each other simply by the rectangular portion 113 of the first lower end flap 112 being placed under the edge 123 of the third lower end flap 122 (see FIG. 2). It will be apparent to those skilled in the art that the lower end flaps 112, 118, 122, 126 may be folded toward the interior of the carton 200 in any sequence of steps in order to form one end of the carton 200.

Upon completion of the above noted steps, the carton 200 is ready to be filled with the products P. It is contemplated that the formation of the carton 200 may be completely automated and occur around the products P that will be shipped in the carton 200 such that the carton 200 is filled as it is formed. Alternatively, the products P may be placed in the carton 200 after the carton is fully formed. In other embodiments, the upper end flaps 110, 116, 120, 124 can be sealed first and the products P may be placed in the lower end of the carton 200, opposite to what was described above. Therefore, the lower end flaps 112, 118, 122, 126 or the upper end flaps 110, 116, 120, 124 may be used as interchangeable throughout.

Figure 5:
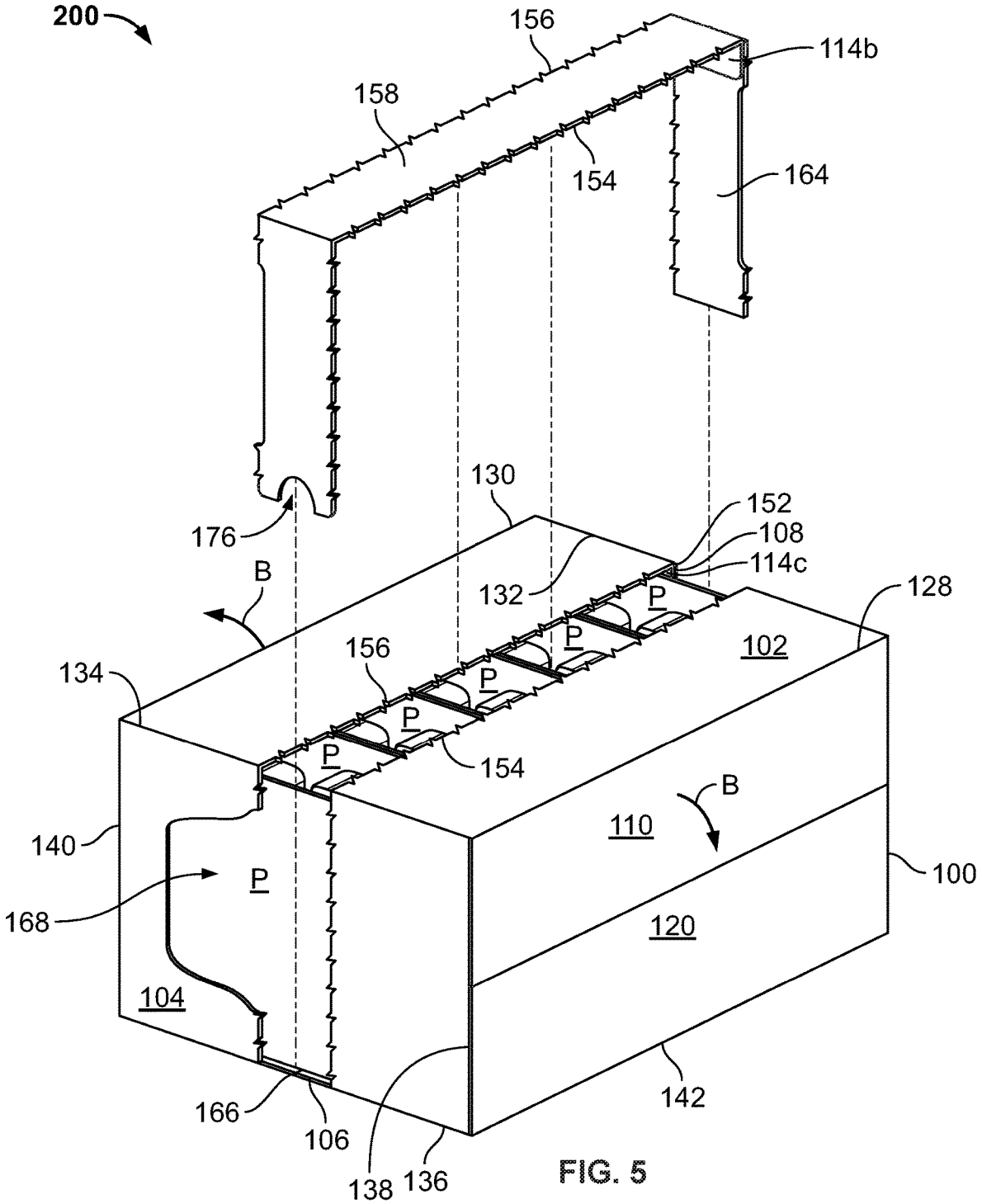
FIG. 5 is an exploded isometric view of the displayable shipping carton of FIG. 3 with the tear feature removed.

During the process of filling the carton 200 with the product P, the products P are placed in the carton 200 in an inverse configuration, such that the products P overlap each other (see FIG. 5). As illustrated in FIG. 5, the products P are configured in two rows, side-by-side to each other. As discussed above, the two rows are inverse to each other such that the two rows partially overlap each other, i.e., top portions of the products P of one row extend to the bottom portion of the other row. This configuration of the products allows for a more efficient use of space in the carton 200. Put differently, the arrangement shown in FIG. 5 allows for less air to be shipped and maximizes the amount of the products P that can be placed in the carton 200. However, the configuration of the products P within the carton 200 may be modified based on many criteria, including the shape of the products P. In one implementation, the products P are rectangular boxes dimensioned to abut interior walls of the carton 200 without loss of space. In alternative embodiments, the products P may not be placed in an inverse configuration and all the products P may be orientated in the same direction. It is contemplated that the products P may be placed in any configuration in the carton 200.

Referring now to FIGS. 1 and 3, after the carton 200 has been filled with products P (or formed around the products P), the second upper end flap 116 and the fourth upper end flap 124 are folded 90 degrees toward the interior of the carton 200 along the upper peripheral edges 138, 146 of the second and fourth main panels 104, 108, respectively. Once the second and fourth upper end flaps 116, 124 are folded, the first upper end flap 110 and the third upper end flap 120 are folded 90 degrees along the upper peripheral edges 128, 142 of the first and third main panels 102, 106, respectfully. Similarly as discussed above with respect to the lower end flaps 112, 118, 122, 126, once the first and third upper end flaps 110, 120 are folded, the first and third upper end flaps 110, 120 are fastened together by any of the techniques noted above, e.g., an adhesive or other attachment means. In one example, tape may be applied to the distal ends of the first and third upper end flaps 110, 120 to secure the first and third upper end flaps 110, 120 together. In alternative embodiments, an adhesive may be placed on the second and fourth upper end flaps 116, 124 prior to folding the first and third upper end flaps 110, 120. The adhesive may then securely fasten the first and third upper end flaps 110, 120 to the second and fourth upper end flaps 116, 124. Alternatively, in other embodiments this step may be omitted. As discussed above, it will be apparent to those skilled in the art that the upper end flaps 110, 116, 120, 124 may be folded toward the interior of the carton 200 in any sequence of steps in order to form one end of the carton 200.

With reference to FIGS. 2 and 3, all sides of the carton 200 are depicted. As noted herein, it is contemplated that the shape and proportions of various parts of the blank 100 may vary depending on the size, weight, and proportions of the products P to be stored and shipped within the carton 200. Further, as discussed above, the blank 100 may be formed in any sequence of steps such that it may comprise a six-sided rectangular box. For example, the upper end flaps 110, 116, 120, 124 may be fastened together prior to the lower end flaps 112, 118, 122, 126. Additionally, as discussed above, the second tear feature 164 is in contact with the first tear feature 158, such that they are co-extensive and/or attached to one another. With reference to FIG. 3, the finger hole 176 on the first tear feature 158 can be viewed. During deconstruction of the carton 200, the user my position at least one finger therein to open the carton 200.

After the assembly process described above is complete, the carton 200 will be configured as shown in FIGS. 2 and 3 (a shipping/storage configuration). The carton 200 may then be shipped to a retail location with the products P loaded therein. Once the carton 200 arrives at the retail location, the carton 200 may be placed on a flat surface by a retailer with the third main panel 106 resting on the flat surface. Additionally, the carton 200 can be opened while being held in the user's hand.

With reference still to FIGS. 2 and 3, a portion of the products P may be viewed from the cutouts 168, 170. The cutouts 168, 170 allow the retailer or consumer to view the product P within the carton 200 without needing to open the carton 200. As a result, the retailer and/or consumer may quickly recognize the contents of the carton 200, without having to tear the carton or otherwise risk damaging the carton and products.

Figure 4:
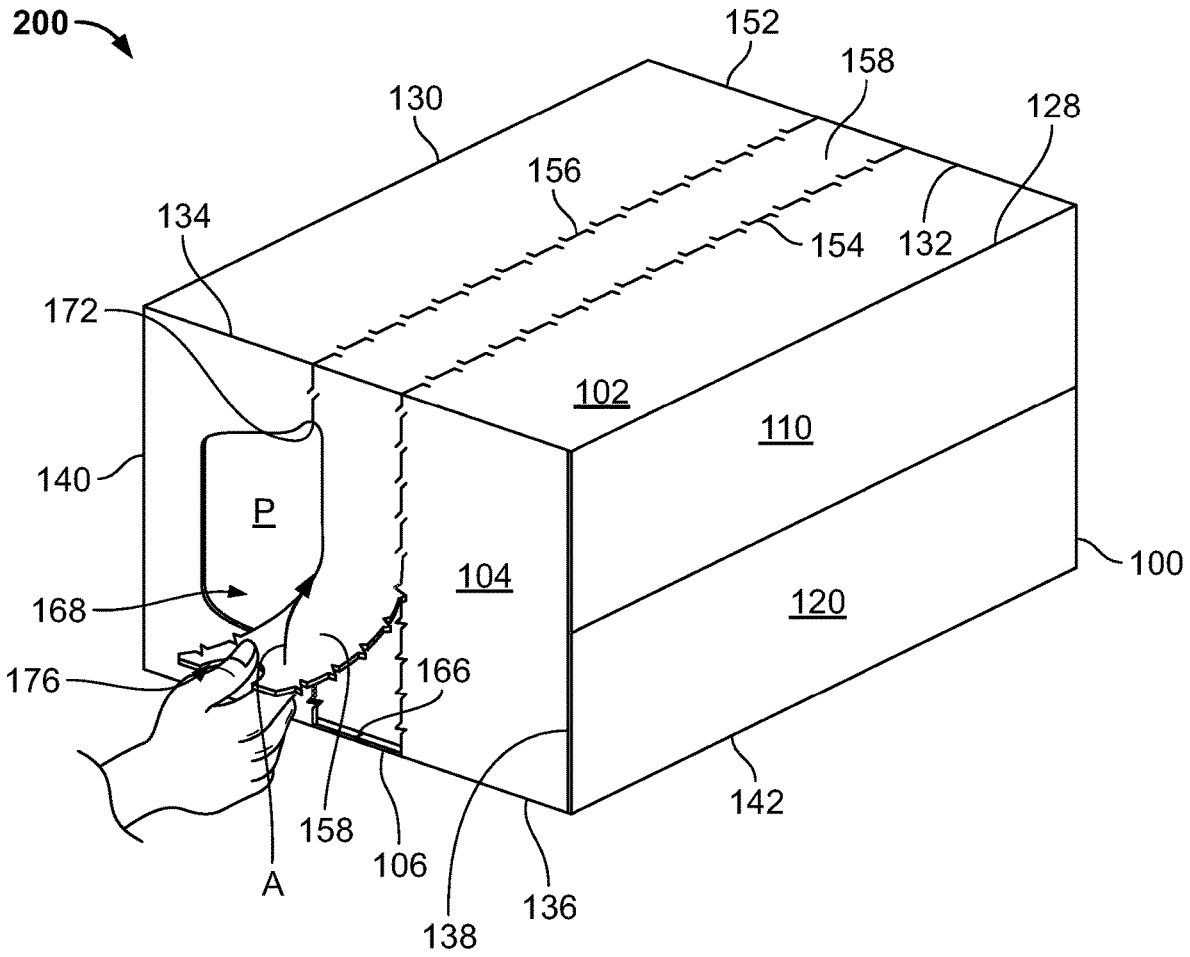
FIG. 4 is an isometric view of the displayable shipping carton of FIG. 3 with a tear feature partially removed.

With reference to FIGS. 1 and 4, the carton 200 is shown resting on the third main panel 106 with the second main panel 104 facing the retailer or user. As illustrated in FIG. 4, the user is shown grasping the first tear feature 158 by surfaces defining the finger hole 176. After the user has grasped the finger hole 176, the user may begin tearing the first tear feature 158 in the direction of arrow A along the first and second lines of separation 154, 156, separating the second main panel 104 in two. With continued force along the direction of arrow A, the first tear feature 158 is completely torn off of the first and second main panels 102, 104, separating both the first and second main panels 102, 104 into two separate sections (see FIG. 5). As discussed above, the second tear feature 164 is adhered to the first tear feature 158, by the attachment flap 114*b*, so that the tearing motion of the user causes the second tear feature 164 to tear along the third and fourth lines of separation 160, 162 with the first tear feature 158. As a result, the fourth main panel 108 may also be separated into two separate sections. After completion of the tearing process, the first and second tear features 158, 164 are removed from the carton 200.

Figure 6:
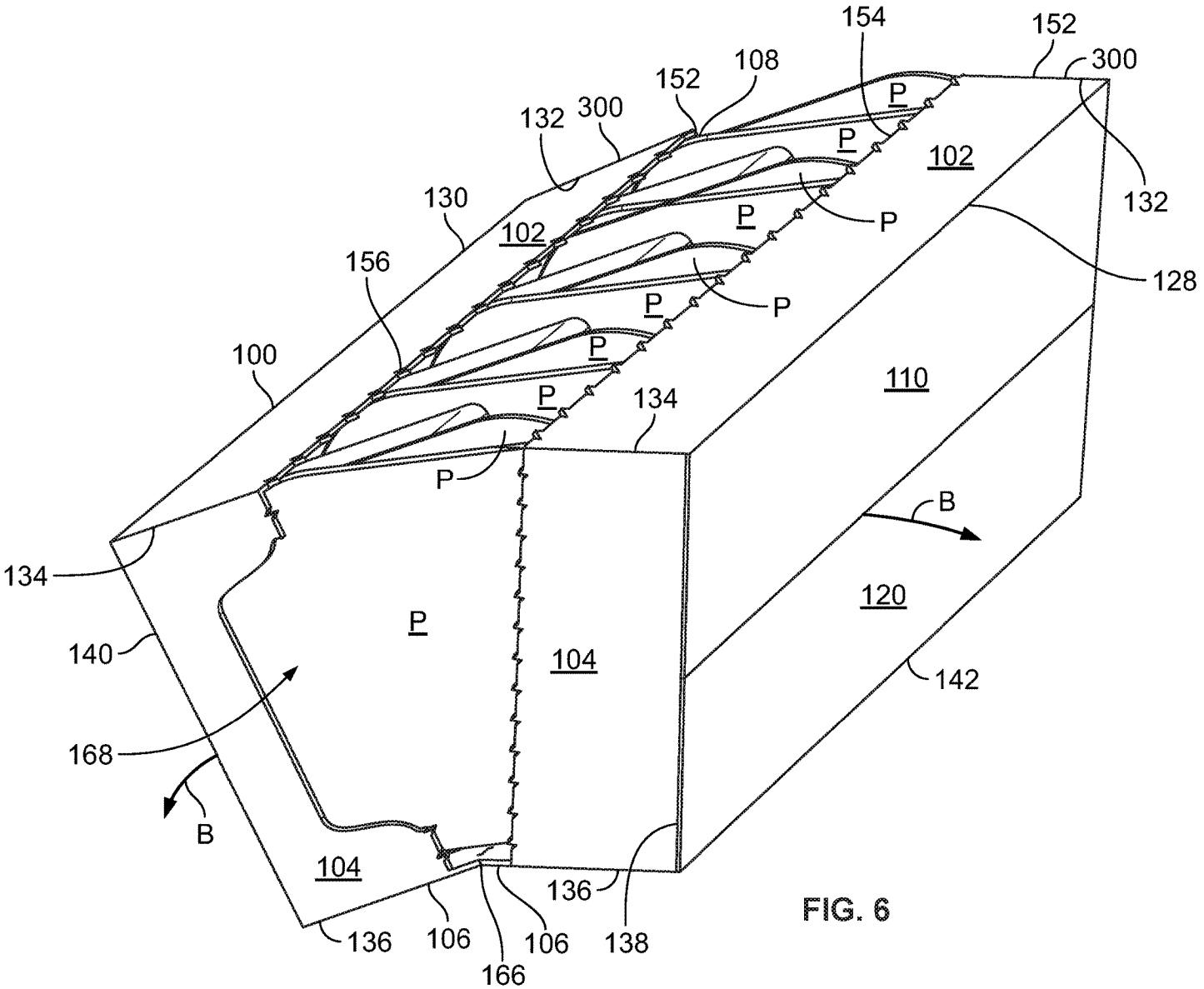
FIG. 6 is an isometric view of the displayable shipping carton of FIG. 5 partially rotated.

With reference still to FIG. 5, the carton 200 is shown in an exploded view with the first tear feature 158 and the second tear feature 164 removed from the carton 200. As discussed above, the first, second, and fourth main panels 102, 104, 108 are split in two by the removal of the first and second tear features 158, 164. In this configuration, the products P can be partially seen extending in two rows, each row being inverse to the other. Upon removal of the first and second tear features 158, 164, the carton 200 may be rotated or pivoted about the single line of separation 166 extending through the third main panel 106 in the direction of arrows B. With reference to FIG. 6, the carton 200 is shown partially rotated about the singe line of separation 166 on the third main panel 106. After the carton 200 rotates 180 degrees in the direction of arrows B from the base position, or 90 degrees from each end defined by the arrows B, (see FIG. 5) the carton 200 is transformed into two dispenser sections 300 (see FIG. 7).

Figure 7:
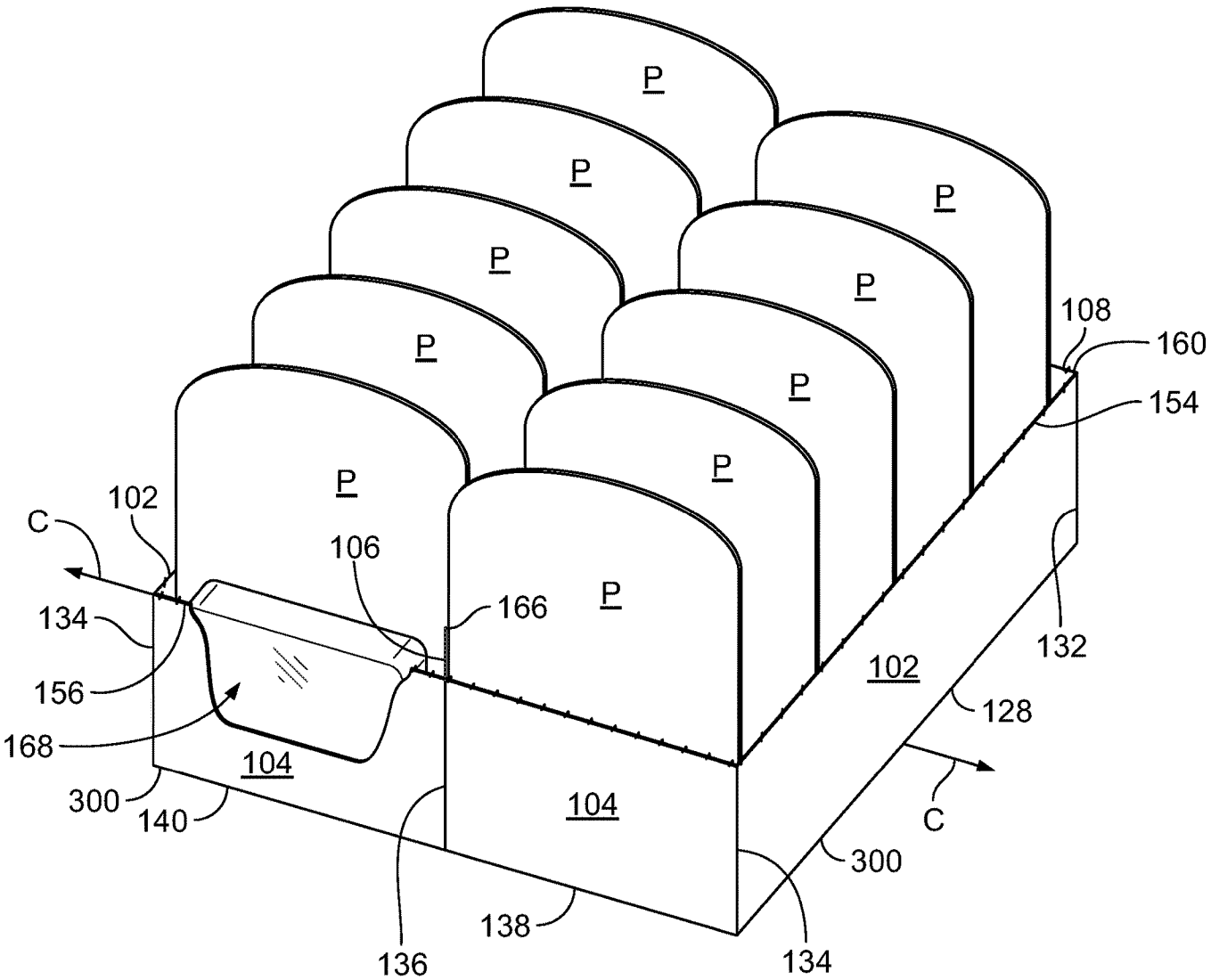
FIG. 7 is an isometric view of the displayable shipping carton of FIG. 5 converted into two attached dispenser sections.

With reference to FIGS. 1 and 7, the carton 200 is transformed into the dispenser sections 300, side-by-side to each other. In this configuration, the upper end flaps 110, 116, 120, 124 and the lower end flaps 112, 118, 122, 126 define bottom ends to the dispenser sections 300. As illustrated in FIG. 7, the third main panel 106 is folded in two along the line of separation 166 and the dispenser sections 300 are positioned in opposite directions. After the carton 200 is converted into the dispenser sections 300, the dispenser sections 300 may be removed from each other. The dispenser sections 300 may be removed from each other by pulling the dispenser sections 300 in opposite directions, i.e., in the direction of arrows C. As the user pulls the dispenser sections 300 apart, the line of separation 166 will tear to allow the two dispenser sections 300 to detach from one another. After the two dispenser sections 300 are detached from one another, they may be rotated such that they may be orientated in the same direction. Alternatively, the line of separation 166 may only allow for a hinging action, e.g., define a fold line, and not be capable or readily capable of tearing.

Figure 8:
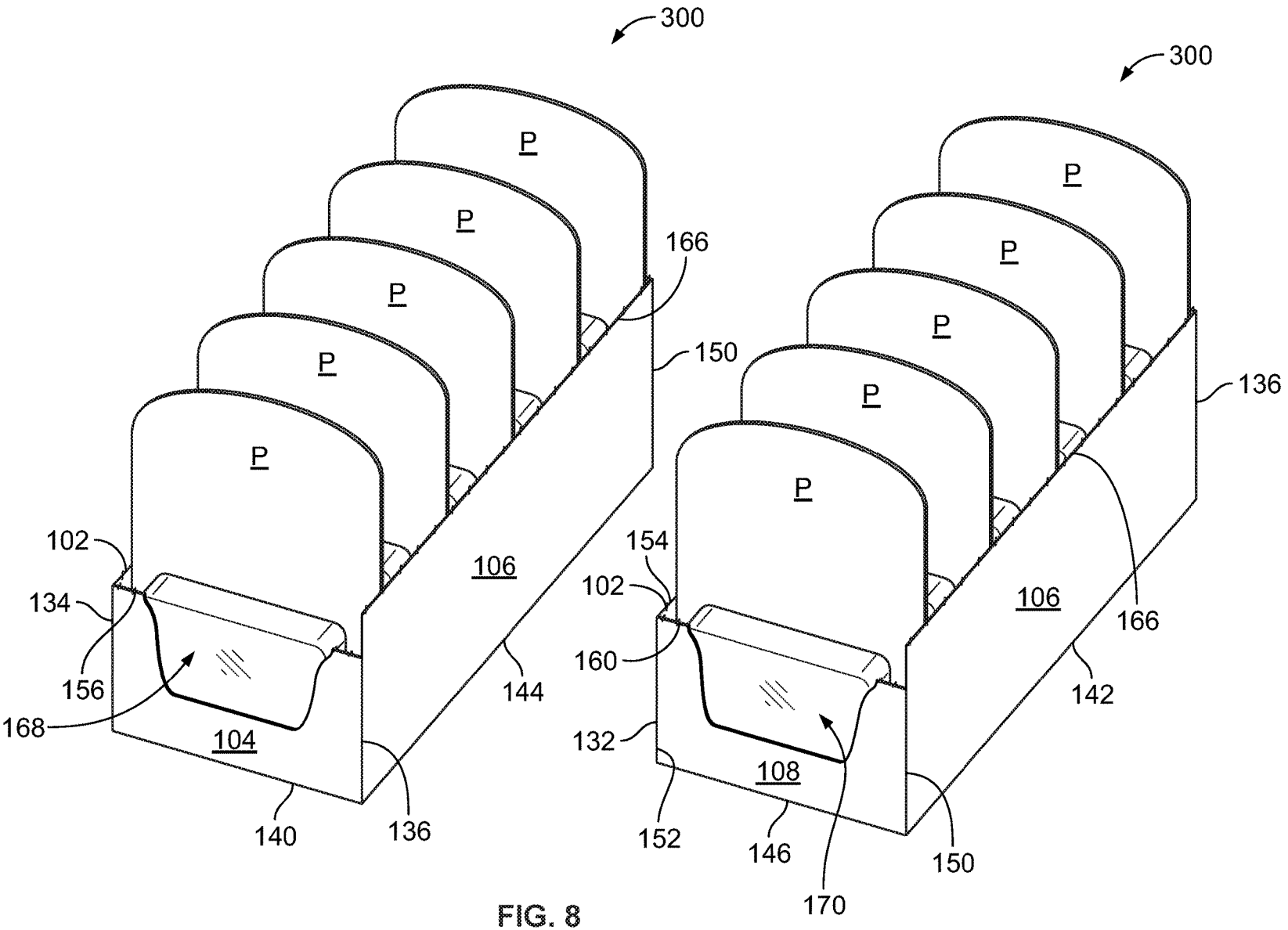
FIG. 8 is an isometric view of the two dispenser sections of FIG. 7 detached from one another.

With reference to FIG. 8, the dispenser sections 300 are shown separated from each other and orientated in the same direction. In this configuration, the dispenser sections 300 may now be placed on a store shelf, for example. Once on the store shelf, the products P can be viewed standing upright such that a consumer may easily see the product in the dispenser sections 300. Further, the first and second cutouts 168, 170 allow the user to view a larger area of the first product P in each row. The ability of the dispenser sections 300 to detach from each other allows the dispenser sections 300 to be placed in different locations around the store. This allows the user to customize their shelf space appropriately without having to have the two dispenser sections 300 constantly in side-by-side relation to each other.

With reference still to FIG. 8, each dispenser section 300 may contain 5 products P disposed therein. However, in alternative embodiments, each dispenser section 300 may contain a greater or fewer number of the products P. As discussed above with respect to FIG. 1, the width W of the first and third main panels 102, 106 is directly correlated to the number of the products P that each of the dispenser sections 300 may hold. Further, although FIG. 8 shows the packaged type product P, any type of product P may be used with the blank 100 to form the carton 200. For example, the carton 200 may contain cylindrical containers, pouches, or bags. Moreover, after all of the products P have been taken out of the dispenser sections 300, the dispenser sections 300 may be discarded (such as by recycling) or filled to hold a different product P therein.

Figure 9:
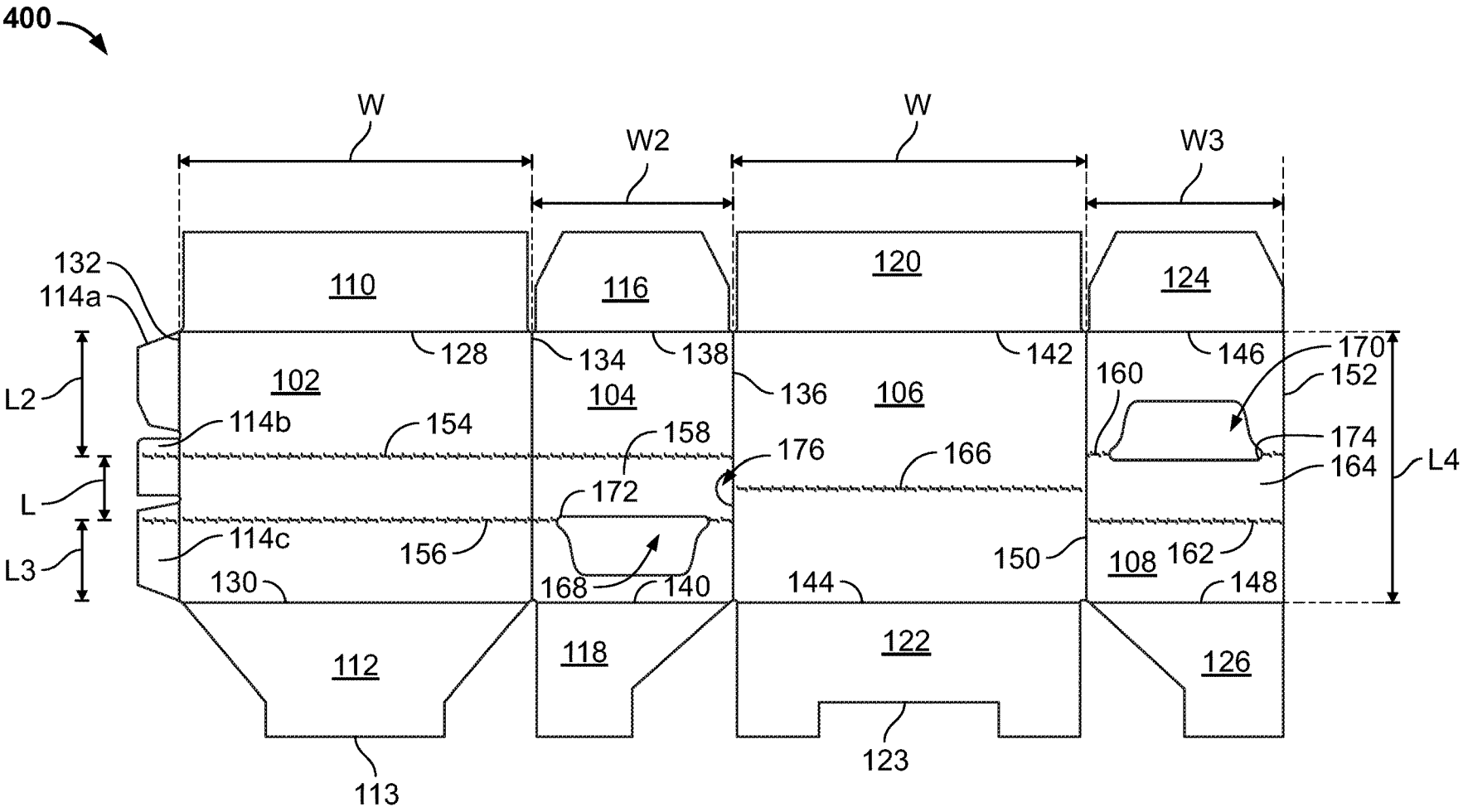
FIG. 9 is a plan view of another embodiment of a blank.

With reference to FIG. 9, like reference numbers are used with regard to an alternative embodiment of a blank 400. The blank 400 may comprise a similar configuration as discussed above. However, in this embodiment, the first and second tear features 158, 160 are shifted downwardly toward the lower end flaps 112, 118, 122, 126. Therefore, the cutouts 168, 170, the lines of separation 154, 156, 160, 162, 166, and the finger hole 176 are also shifted downwardly. As a result, the first and second tear features 158, 160 are not positioned in the center of the blank 400 with respect to the first, second, and fourth main panels 102, 104, 108, i.e., the length L2 is greater than the length L3. The configuration of FIG. 9 allows the blank 400 to hold two different sized products P therein. Put differently, the blank 400 allows one row of products to contain products that are larger or smaller than the second row of products. In further embodiments, the first and second tear features 158, 160 may extend across the blank 400 at any position. In other embodiments, attachment flaps 114*a*, 114*b*, 114*c* may not comprise the first and second lines of separation 154, 156 extending therethrough. Rather, the attachment flaps 114*a*, 114*b*, 114*c* may be uninterrupted throughout.

With reference to FIGS. 1-9, the blank 100, 400, the carton 200, and the dispenser sections 300 are illustrated without any graphics or illustrations on the outer surfaces. However, in alternate embodiments, the blank 100, 400, the carton 200, and the dispenser sections 300 may comprise a plurality of logos, graphics, or text located throughout.

Figure 10:
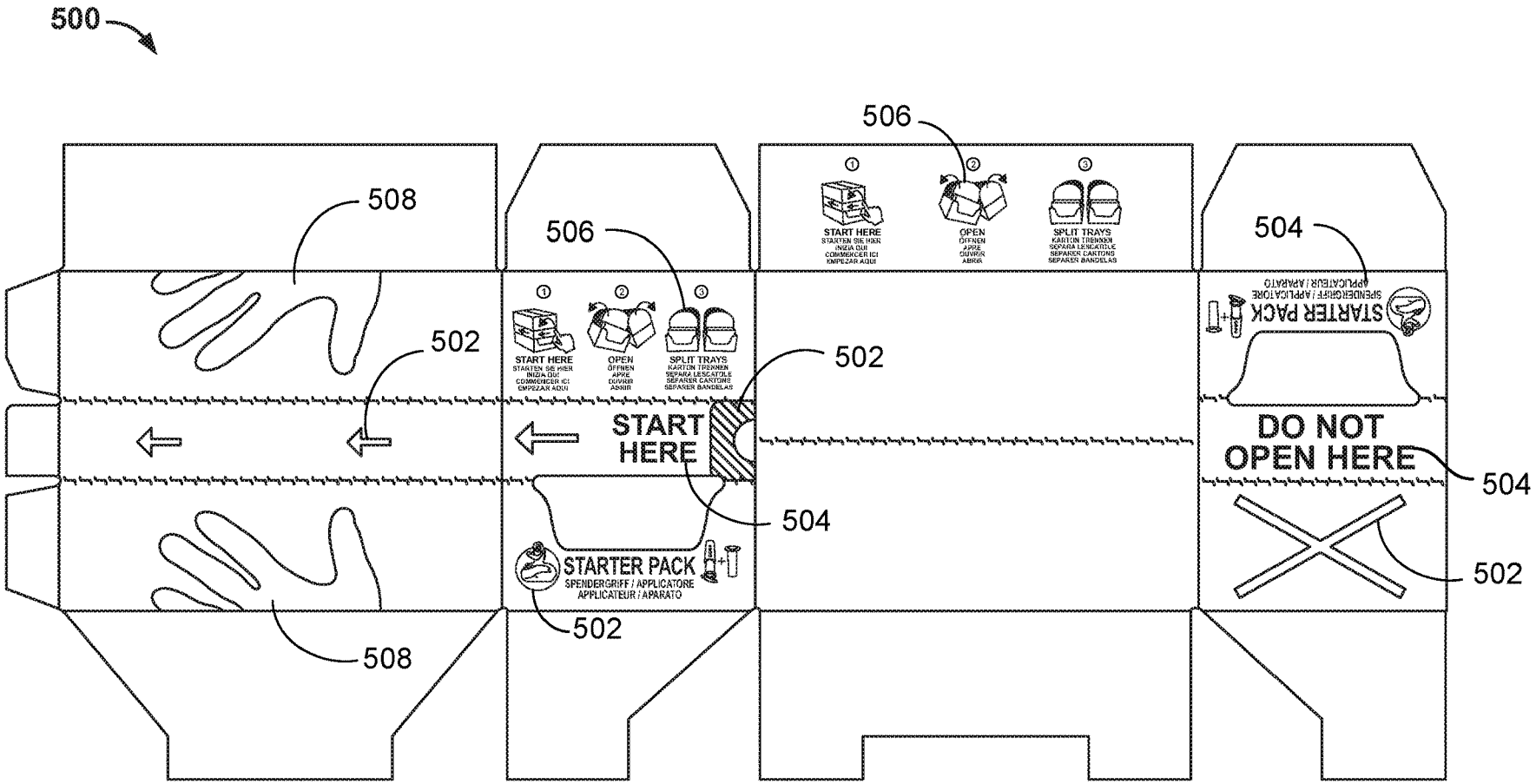
FIG. 10 is a plan view of still another embodiment of a blank.

With reference to FIG. 10, an alternative embodiment of a blank 500 is illustrated. The blank 500 comprises the same configuration as the blank 100 and may be formed into the carton 200 and the dispenser sections 300. The blank 500 includes one or more of logos, graphics, iconography 502, and text 504. The text 504 or iconography 502 may indicate to the retailor and/or the consumer the contents within the carton 200 and the dispenser sections 300. Additionally, the iconography 502 may provide instructions that indicate to the user how to appropriately open the carton 200. The blank 500 further includes pictures 506 on the outside of the blank 500 that outline the steps necessary to convert the carton 200 into the dispenser sections 300. For example, hand prints 508 may be placed on the blank 500 that indicate to the retailer how to appropriately manipulate the carton 200 into an operable position. As such, the iconography 502 allow retailers from different locations around the world to successfully convert the carton 200 into the dispenser sections 300 without needing to know a particular language. It is contemplated that the blank 500 may comprise any number or type of iconography 502 or text 504 on the blank 500. Additionally, in alternative embodiments, the iconography 502 and text 504 may be placed at different positions on the blank 500.

As noted herein, the blank 100, 400, 500 and the carton 200 are capable of offering a high number of benefits to the retailer or consumer. For example, the blank 100, 400, 500 and the carton 200 allow the retailer to easily tear predetermined sections from the carton 200, without needing any cutting tools. Further, the design and configuration of the blank 100, 400, 500 and the carton 200 create appealing dispenser sections 300 for retailers to use without needing to purchase additional storage or shelf dividers. As such, the blank 100, 400, 500 and the carton 200 create an easier working experience for the retailer and protects the products P from being damaged during opening of the carton 200.

Furthermore and as discussed above, the carton 200 is suited for shipping and displaying a plurality of articles or products P. Additionally, the blank 100, 400, 500 and the carton 200 allow for an increase in efficiency in the shipping and packaging phase. In other words, the blank 100, 400, 500 and the carton 200 allow for a greater amount of the products P to be shipped while using less material. Further, the blank 100, 400, 500 and the carton 200 requires less time and operation on the retailer's end to set up or replenish shelves. Furthermore, the design and configuration of the blank 100, 400, 500 and the carton 200 is more sustainable, uses less packaging waste, transports less air, and maximizes truck utilization compared to prior shipping cartons. Therefore, the blank 100, 400, 500 and the carton 200 allow for substantial savings to the manufacturer and benefits to the environment.

As further discussed above, the lines of separation 154, 156, 160, 162, 166 may define any type of pattern or disruption extending through or into the blank 100, 400, 500. However, it is contemplated that the blank 100, 400, 500 may comprise any number or type of weakened sections extending through the blank 100, 400, 500 instead of the lines of separation 154, 156, 160, 162, 166. For example, the blank 100, 400, 500 may comprise areas that are treated chemically to weaken specific portions of the blank 100, 400, 500. Further, specific portions of the blank 100, 400, 500 may be designed or treated to be weakened or opened by exposure to UV light. Additionally, in other embodiments, the first and second tear feature 158, 164 may comprise a greater or fewer number of lines of separation than illustrated, or the first and second tear features 158, 164 may be torn as a single tear feature. Put differently, the first and second tear feature 158, 164 may be defined by a single line of separation or area of weakness that extends through portions of the blank 100, 400, 500 instead of having two parallel lines of separation. In further embodiments, the blank 100, 400, 500 may comprise areas of weakness or lines of separation that are capable of opening themselves upon arrival at a specific predetermined position or location.

Any of the embodiments described herein may be modified to include any of the structures or methodologies disclosed in connection with other embodiments. Further, although directional terminology, such as front, back, upper, lower, vertical, horizontal, etc. may be used throughout the present specification, it should be understood that such terms are not limiting and are only utilized herein to convey the orientation of different elements with respect to one another.

INDUSTRIAL APPLICABILITY

The invention relates to a carton for containing and displaying a product. The carton may be transformed into multiple dispenser sections in order for products to be viewed and displayed more efficiently.

We claim:

1. A carton blank, comprising:

a first main panel;

a second main panel foldably attached with the first main panel;

a third main panel foldably attached with the second main panel;

a fourth main panel foldably attached with the third main panel;

a pair of parallel lines of separation extending through the first main panel, the second main panel, and the fourth main panel, wherein the pair of parallel lines of separation are equidistant from one another throughout the first main panel, the second main panel, and the fourth main panel, and wherein the pair of parallel lines of separation define a first tear feature extending through the first main panel and the second main panel, and a second tear feature extending through the fourth main panel;

a single line of separation extending through the third main panel, connecting the first and second tear features;

a plurality of uninterrupted attachment flaps extending from the first main panel, opposite the second main panel, the plurality of uninterrupted attachment flaps including a first uninterrupted attachment flap, a second uninterrupted attachment flap, and a third uninterrupted attachment flap, and at least one cutout extending through at least one of the first main panel, the second main panel, or the fourth main panel along at least one of the pair of parallel lines of separation, wherein the first tear feature extends from one of the second uninterrupted attachment flap and the second uninterrupted attachment flap is positioned entirely between the pair of parallel lines of separation extending through the first main panel, the second main panel, and the fourth main panel, and wherein a first gap is positioned between the first uninterrupted attachment flap and the second uninterrupted attachment flap, and a second gap is positioned between the third uninterrupted attachment flap and the second uninterrupted attachment flap, and wherein the first gap and the second gap extend to the first main panel.

2. The carton blank of claim 1, wherein a portion of the at least one cutout extends partially into at least one of the first tear feature or the second tear feature.

3. The carton blank of claim 1, wherein the first tear feature includes a finger hole extending through the second main panel.

4. The carton blank of claim 1, wherein a plurality of uninterrupted end flaps are foldably attached to and extend from opposite ends of each of the first main panel, the second main panel, the third main panel, and the fourth main panel by way of a plurality of peripheral edges.

5. The carton blank of claim 4, wherein the pair of parallel lines of separation are parallel and equidistant with the peripheral edges defined by the plurality of uninterrupted end flaps.

6. The carton blank of claim 1, wherein the at least one cutout includes a first cutout that extends through the second main panel along a portion of the first tear feature and a second cutout that extends through the fourth main panel along a portion of the second tear feature.

7. The carton blank of claim 6, wherein the first cutout and the second cutout extend in opposite directions from one another.

8. The carton blank of claim 1, wherein a first vertical fold line separates the first main panel from the plurality of uninterrupted attachment flaps, wherein the first gap widens moving in a direction away from the first vertical fold line, and wherein the second gap widens moving in a direction away from the first vertical fold line.

9. A carton blank, comprising:

a first main panel;

a second main panel foldably attached with the first main panel;

a third main panel foldably attached with the second main panel;

a fourth main panel foldably attached with the third main panel;

a pair of uninterrupted end flaps foldably attached to and extending from opposite ends of each of the first main panel, the second main panel, the third main panel, and the fourth main panel by way of a plurality of peripheral edges;

a pair of parallel lines of separation extending through the first main panel, the second main panel, and the fourth main panel, wherein the pair of parallel lines of separation are equidistant from one another and from the peripheral edges of each main panel throughout the first main panel, the second main panel, and the fourth main panel, and wherein the pair of parallel lines of separation define a first tear feature extending through the first main panel and the second main panel, and a second tear feature extending through the fourth main panel;

a single line of separation extending through a middle of the third main panel, connecting the first and second tear features; and a plurality of uninterrupted attachment flaps extending from the first main panel, opposite the second main panel, the plurality of uninterrupted attachment flaps including a first uninterrupted attachment flap, a second uninterrupted attachment flap, and a third uninterrupted attachment flap, wherein the first tear feature extends from the second uninterrupted attachment flap and the second uninterrupted attachment flap is positioned entirely between upper and lower extents of the first tear feature and the second tear feature, and wherein a first gap is positioned between the first uninterrupted attachment flap and the second uninterrupted attachment flap, and a second gap is positioned between the third uninterrupted attachment flap and the second uninterrupted attachment flap, and wherein the first gap and the second gap extend to the first main panel.

10. The carton blank of claim 9, wherein the carton blank comprises at least one cutout extending through at least one of the first main panel, the second main panel, or the fourth main panel along the pair of parallel lines of separation.

11. The carton blank of claim 10, wherein a portion of the at least one cutout extends partially into at least one of the first tear feature or the second tear feature.

12. The carton blank of claim 9, wherein the first tear feature includes a finger hole extending through the second main panel.

13. The carton blank of claim 9, wherein a first vertical fold line separates the first main panel from the plurality of uninterrupted attachment flaps, wherein the first gap widens moving in a direction away from the first vertical fold line, and wherein the second gap widens moving in a direction away from the first vertical fold line.

14. A carton, comprising:

a first main panel;

a second main panel foldably attached with the first main panel;

a third main panel foldably attached with the second main panel;

a fourth main panel foldably attached with the third main panel;

a pair of uninterrupted end flaps foldably attached to and extending from opposite ends of at least one of the first main panel, the second main panel, the third main panel, or the fourth main panel by way of a peripheral edge of each main panel;

a first perforated tear pattern extending through the first main panel and the second main panel;

a second perforated tear pattern extending through the fourth main panel;

a third perforated tear pattern extending through a middle of the third main panel from a first fold line to a second fold line;

a first cutout extending through the second main panel along the first perforated tear pattern; and a second cutout extending through the fourth main panel along the second perforated tear pattern, the first and second cutouts extending in opposite directions from one another, wherein the first cutout extends partially into, but not entirely through, the first perforated tear pattern, and the second cutout extends partially into, but not entirely through, the second perforated tear pattern, wherein the first perforated tear pattern and the second perforated tear pattern are parallel with the peripheral edges, and the first perforated tear pattern and the second perforated tear pattern are equidistant from the peripheral edges of each main panel throughout the first main panel, the second main panel, and the fourth main panel, wherein the first perforated tear pattern and the second perforated tear pattern are aligned with one another, and wherein the first perforated tear pattern comprises a first uninterrupted attachment flap extending therefrom, and the first uninterrupted attachment flap is attached to an interior surface of the second perforated tear pattern.

15. The carton of claim 14, wherein the carton comprises a second uninterrupted attachment flap that is configured to attach with an interior surface of the fourth main panel.

16. The carton of claim 15, wherein the second uninterrupted attachment flap extends from the first main panel.

17. The carton of claim 14, wherein removal of the first perforated tear pattern results in the removal of the second perforated tear pattern from the carton.

18. The carton of claim 17, wherein upon removal of the first perforated tear pattern and the second perforated tear pattern, the carton transforms into two dispenser sections, side-by-side to each other, and wherein the dispenser sections are removable from each other.

19. The carton of claim 14, wherein the carton is capable of rotating along the third perforated tear pattern.

20. The carton of claim 19, wherein the carton is further capable of separating into two detached dispenser sections along the first perforated tear pattern, the second perforated tear pattern, and the third perforated tear pattern.

* * * * *